United States Patent [19]

Jacobsen

[11] 4,353,301

[45] Oct. 12, 1982

[54] SMOKE GRENADE

[75] Inventor: Kjell O. Jacobsen, Raufoss, Norway

[73] Assignee: A/S Raufoss Ammunisjonsfabrikker, Raufoss, Norway

[21] Appl. No.: 191,005

[22] Filed: Sep. 26, 1980

Related U.S. Application Data

[63] Continuation of Ser. No. 16,375, Mar. 1, 1979, abandoned.

[30] Foreign Application Priority Data

Mar. 8, 1978 [NO] Norway ..... 780818

[51] Int. Cl.[3] ..... F42B 113/44

[52] U.S. Cl. ..... 102/334; 102/482; 102/286; 102/368

[58] Field of Search ..... 102/334, 364, 365, 367–370, 102/482–488, 513, 286

[56] References Cited

U.S. PATENT DOCUMENTS

| | | | |
|---|---|---|---|
| 1,847,268 | 3/1932 | Schladt | 102/37.6 X |
| 2,094,562 | 9/1937 | Lowy | 102/65 |
| 3,625,855 | 12/1971 | Duda | 149/37 |
| 3,710,723 | 1/1973 | Muller | 102/87 |
| 3,972,291 | 8/1976 | Braun, Jr. | 102/87 |

FOREIGN PATENT DOCUMENTS

| | | | |
|---|---|---|---|
| 1157115 | 11/1963 | Fed. Rep. of Germany | 102/66 |
| 1913790 | 6/1973 | Fed. Rep. of Germany . | |
| 2556075 | 6/1976 | Fed. Rep. of Germany | 102/503 |
| 2647538 | 4/1978 | Fed. Rep. of Germany | 102/66 |
| 2308899 | 12/1976 | France | 102/66 |

*Primary Examiner*—Harold J. Tudor
*Attorney, Agent, or Firm*—Larson and Taylor

[57] ABSTRACT

A smoke grenade for providing screening. A container has in the lower portion thereof a discharge composition ignited by a primer composition for igniting an ignition/bursting composition which in turn ignites a set of easily ignitable smoke charges, preferably disc shaped smoke charges surrounding the ignition/bursting composition. Ahead of the first charges in the direction of travel of the grenade is a further smoke charge which is compact and hence more slowly ignitable than the first set of charges. A delay booster and a further primer composition ignite this further smoke charge after a delay.

2 Claims, 1 Drawing Figure

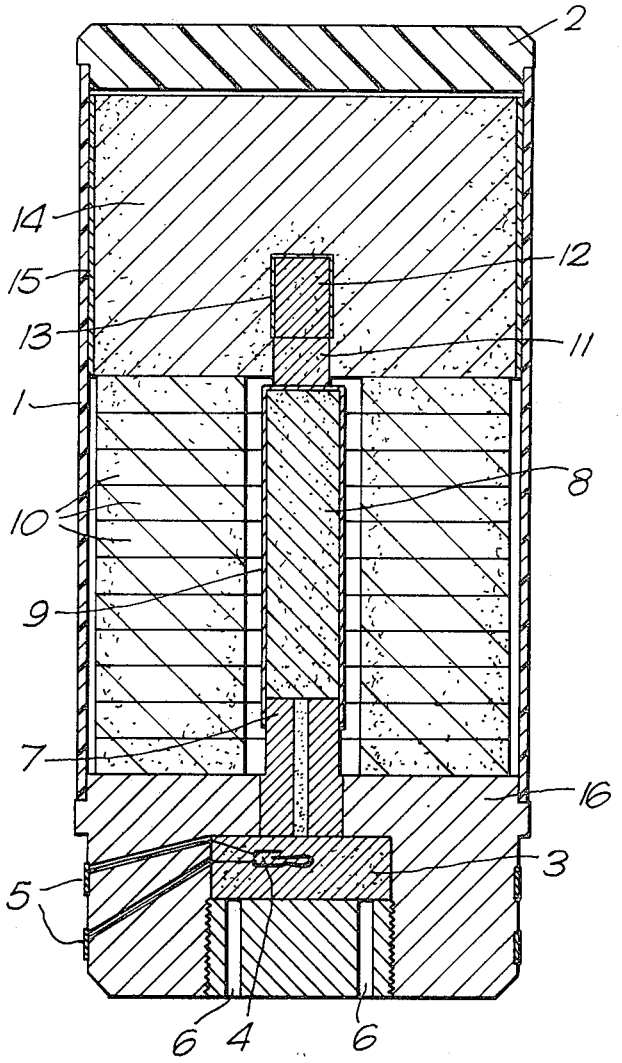
2
14
15
12
13
11
1
8
10
9
7
16
3
5
6
4
6

SMOKE GRENADE

This is a continuation of application Ser. No. 16,375, filed Mar. 1, 1979, now abandoned.

The present invention relates to a smoke grenade for generating smoke for vehicle screening, comprising a casing which contains a discharge composition, a smoke charge and a primer/bursting charge for said smoke charge.

In combat it is of the greatest importance to be able to screen one's own combat vehicles against enemy fire. This may be achieved in various manners. One such method is vehicle screening by creating a smoke screen in the desired area.

There are different manners of creating a smoke screen in the desired area. Such smoke screening may be generated by smoke charges. Said smoke charges are ignited and fired in the area to be screened.

Such a device for igniting a smoke or flame generating charge is known from the BRD Patent Specification No. 1 193 790, which describes a smoke grenade with reference to FIGS. 1 and 2. Said smoke grenade is set off by a discharge composition and is filled with smoke charge elements to be ignited at a desired time after firing by a primer. Futhermore, there are arranged discharge and bursting charges in the pressure chamber which send the ignited smoke or fire elements off like small shot from the grenade. This is indicated in FIG. 3. FIG. 6 of said Specification shows another embodiment. This consists of a smoke cartridge causing the smoke charge elements not to be spread at such heights as is typical of the above mentioned smoke grenade.

A primer composition is ignited within an ignition tube and in turn ignites the smoke elements as well as the discharge composition which is placed within the pressure chamber. By pressure on a washer the charge is set off at the same time as an easily releasable cover is thrown off and the smoke elements are dispersed.

The present invention is characterized in that the smoke charge consists of at least two smoke generating part charges having different reaction and/or smoke generating rates.

Between said part charges there are preferably arranged primers with a time delay to cause a stepped ignition of the part charges.

In an especially preferred embodiment of the invention disk shaped smoke charge elements are arranged around an ignition bursting charge for rapid smoke generation, which in the discharge direction are succeeded by a booster with a delayed ignition of a primer composition surrounded by a HC-composition for slower smoke generation. Said HC composition is placed in the upper portion of said smoke grenade.

With devices of this kind both instantaneous and lasting smoke generation are achieved. By the aid of such devices, thus, instantaneous smoke screening combined with lasting smoke screening is achieved to a degree that is not known to the applicant from previously known smoke screening devices. The smoke grenade according to the invention, thus, enriches the present state of technology.

The present invention is described in more detail below with reference to an embodiment disclosed in the drawing.

A smoke grenade, the upper part of which is limited by a plastic tube 1 and a plastic cover 2, is in its lower portion provided with a discharge 3 comprising a primer composition 4. Said primer composition 4 is on its outside connected with contact copper rings 5 arranged on the cylindrical face of the smoke grenade. From the discharge composition 3 two nozzles 6 extend downwards to the lower end face of the smoke grenade. From the discharge composition 3 a booster with a delay 7 extends upwards to an ignition/bursting composition 8 in an aluminium casing 9. Said aluminium casing 9 is surrounded by disk shaped smoke charge elements 10. Smoke charge elements 10, thus, end at the upper end of the ignition/bursting composition 8. In the extension of said ignition/bursting composition 8 there is a booster with a short delay effect 11. Above this a primer composition 12 is arranged in a lead casing 13. About said booster composition with a delay 11 and the lead casing 13 there is a HC composition 14 in a steel casing 15. In the longitudinal direction of the cylinder, the HC composition 14 in steel casing 15 is, thus, limited by the smoke disk elements 10 at the lowermost side and by the plastic cover 2 on top.

The mode of operation of the described smoke grenades is as follows:

When current is supplied to the contact rings 5, the primer composition 4 in the discharge 3 is ignited. Due to ignition of the discharge compositions 3 the gas formed will escape through nozzles 6, so that the smoke grenade is ejected forwards in the opposite direction of the escaping drive gas. Simultaneously the booster with delay 7 burns. When it has burned through, the ignition/bursting charge 8 is ignited. Its reaction will burst the aluminium shell 9 and the smoke disk elements 10 are ignited and thrown out for dispersion. Simultaneously the booster with a short delay 11 is ignited. When it is burned through, the primer charge 12 is ignited. By this ignition the lead shell 13 is disrupted and the HC composition 14 in steel box 15 is ignited. By smoke generation during a longer span of time this last composition will secure smoke screening as desired.

The above embodiment is meant as an illustration of the invention and not as a limitation of the scope of the invention as stated in the claims.

I claim:

1. A smoke grenade for producing smoke for screening purposes, comprising: a casing containing a discharge composition for propelling the casing, a primer positioned to ignite the discharge composition, a first delay means, an ignition/bursting composition contained in a disruptable tube and positioned to be ignited via said first delay means, after a predetermined delay, by said discharge composition, and a set of easily ignitable annular disc shaped smoke charges surrounding the ignition/bursting change and positioned to be ignited and immediately broken up and thrown outwardly laterally, by said ignition/bursting composition for rapid wide spread smoke production, a further smoke charge which is compact and hence burns more slowly than the first said smoke charges and which is positioned ahead of the first said smoke charges taken in the direction of travel of the grenade, and further ignition means positioned to ignite the further smoke charge, a further delay means, said further ignition means being ignitable by said ignition/bursting composition via said further delay means, after a pre-determined delay, for igniting said further smoke charge.

2. A smoke grenade according to claim 1, said further smoke charge being HC composition.

* * * * *